US005884755A

United States Patent [19]

Vaccarella

[11] Patent Number: 5,884,755

[45] Date of Patent: Mar. 23, 1999

[54] REVOLVING COIN DISPLAY STAND

[76] Inventor: Richard M. Vaccarella, 103 White Doe Ct., Newport, N.C. 28570

[21] Appl. No.: 893,517

[22] Filed: Jul. 11, 1997

Related U.S. Application Data

[60] Provisional application No. 60/021,550 Jul. 11, 1996.

[51] Int. Cl.[6] ..... A45C 1/00; A47F 3/10; A47F 7/00

[52] U.S. Cl. ..... 206/0.84; 211/69.6; 211/70; 312/125

[58] Field of Search ..... 206/0.8, 0.81, 206/0.83, 0.84, 566; 40/323, 358; 211/49.1, 58, 164, 70, 69.1, 69.5, 69.6; 312/97.1, 125, 135, 167; D19/21, 23

[56] References Cited

U.S. PATENT DOCUMENTS

| | | | |
|---|---|---|---|
| D. 80,077 | 12/1929 | Fischer | D19/23 |
| 452,377 | 5/1891 | Kean | 312/125 |
| 1,484,044 | 2/1924 | Toborg | 206/0.83 |
| 1,781,769 | 11/1930 | Stout | 312/125 |
| 2,672,977 | 3/1954 | Seitz | 206/0.83 |
| 3,474,897 | 10/1969 | Rambow | 206/0.84 |
| 3,554,625 | 1/1971 | Sly, Sr. | 206/0.83 X |
| 3,601,461 | 8/1971 | Melcher | 312/125 |
| 3,620,363 | 11/1971 | Donnithorne | 211/164 X |
| 3,776,643 | 12/1973 | Titoff | 206/0.84 X |
| 3,910,408 | 10/1975 | Husney et al. | 206/0.81 |
| 4,070,782 | 1/1978 | Vasallo | 40/323 |

*Primary Examiner*—Bryon P. Gehman
*Attorney, Agent, or Firm*—Mills Law Firm PLLC; Clifford F. Rey

[57] ABSTRACT

A revolving coin display stand for the display of proof coin sets encased in hermetically sealed plastic display cartridges is disclosed. The coin display stand is constructed so as to permit a user to view both the obverse and reverse sides of the coins by manually revolving a pivoting frame assembly 360 degrees relative to a supporting base plate. The base plate is constructed of sufficient weight to prevent the proof coin set which is permanently captured in the supporting frame from toppling over during rotation by a user. In an alternative embodiment the supporting base is provided with writing implement holders adapted to receive implements such as pens and pencils in the maimer of a traditional desk set.

7 Claims, 4 Drawing Sheets

REVOLVING COIN DISPLAY STAND

CLAIM OF BENEFIT OF PROVISIONAL APPLICATION

This Application claims the benefit under 35 U.S.C. 119(e) of U.S. Provisional Application No. 60/021,550 filed Jul. 11, 1996 by Richard M. Vaccarella for Revolving Coin Display Stand.

BACKGROUND OF INVENTION

1. Field of Invention

This invention relates to display devices and, more particularly, to a framed display stand for viewing proof coin sets and related items.

Despite the recent popularity of coin collecting as a hobby and avocation, numismatic enthusiasts are commonly faced with the problem of not being able to display their United States proof coin sets. This is due in part to the manner in which such coins are made available to the collector.

Since 1968 the United States Mint has offered the proof coin set in a rigid plastic display cartridge. This plastic display cartridge is known as the lens and it hermetically encapsulates the proof coins thereby protecting the same from dust, dirt and any other contaminants which may be present while handling and viewing the proof coin set. However, due to the lack of a suitable display stand, which will allow the user to view both the obverse and reverse sides of the coins, these proof coin sets are usually placed in a drawer and forgotten.

Although the United States Mint has made some display stands available for this purpose, the result has been unsatisfactory. For example, the display stands supplied by the United States Mint from 1973 to 1982 are noted for a high center of gravity which causes the coin display to topple over easily resulting in damage to the lens cartridge and to the coins as well.

Thus, there is a need for a coin display stand which is adapted to receive a standard size proof coin set and which will permit viewing of both the obverse and reverse sides of the enclosed coins.

2. Description of Related Prior Art

U.S. Pat. No. 540,660 to Rodolph E. Hansen discloses a picture exhibitor comprising a rectangular display casing that is pivotally mounted between a pair of vertical posts for the display of photographs or other pictures.

U.S. Pat. No. 488,042 to Alfred Svensson also discloses a picture exhibitor including a picture case that is mounted on a horizontally disposed shaft between a pair of vertically disposed brackets. The picture case is capable of rotation between the brackets for the display of photographs within the revolving case.

U.S. Pat. No. 642,576 to William Boydell discloses a displaying device including a rectangular, glass covered frame for the display of cards which is pivotally mounted so as to be revolvable between a pair of vertically disposed brackets.

U.S. Pat. No. 716,367 to Ernst Bekker et al. discloses a revolving photograph cabinet that may be revolved by hand or other means on studs secured to an easel or other suitable stand. A means is provided for separating an upper tier of photographs from a lower tier and at the same time to serve as a guide to permit the odd picture in the upper tier to slide to a vacant space in the lower tier at each half-revolution of the cabinet.

Finally, U.S. Pat. No. 3,312,197 to Forrest W. Smith is considered of general interest in that it discloses a facsimile coin embedded in transparent plastic where only one side of the facsimile coin is visible. This device is intended as an ornamental paper weight which may be useful to hold down papers or which may be mounted on a wall for purely ornamental purposes.

SUMMARY OF THE INVENTION

After much research and study of the above mentioned problems, the present invention has been developed to provide a revolving coin display stand which is adapted to receive a standard proof coin set and which will permit viewing of both the obverse and reverse sides of the enclosed coins.

The display stand of the present invention includes a frame assembly which is imparted with 360° rotation about the base support to permit proper viewing and to reduce the chance of damaging the proof coin set due to mishandling.

In view of the above, it is an object of the present invention to provide a coin display stand which is adapted to receive a standard size proof coin set made available to collectors from the United States Mint.

Another object of the present invention is to provide a revolving coin stand which will permit viewing of both the obverse and reverse sides of the enclosed coins.

Another object of the present invention is to provide a revolving coin stand having a relatively low center of gravity which enables the proof coin set to be properly viewed without falling due to an unbalanced condition thereof.

Other objects and advantages of the present invention will become apparent and obvious from a study of the following description and the accompanying drawings which are merely illustrative of such invention.

BRIEF DESCRIPTION OF DRAWINGS

FIG. 4 is a side elevational view of the revolving coin display stand showing the rotational movement of the frame assembly about longitudinal axis A; and .

DETAILED DESCRIPTION OF THE PREFERRED EMBODIMENT

Figure 1:
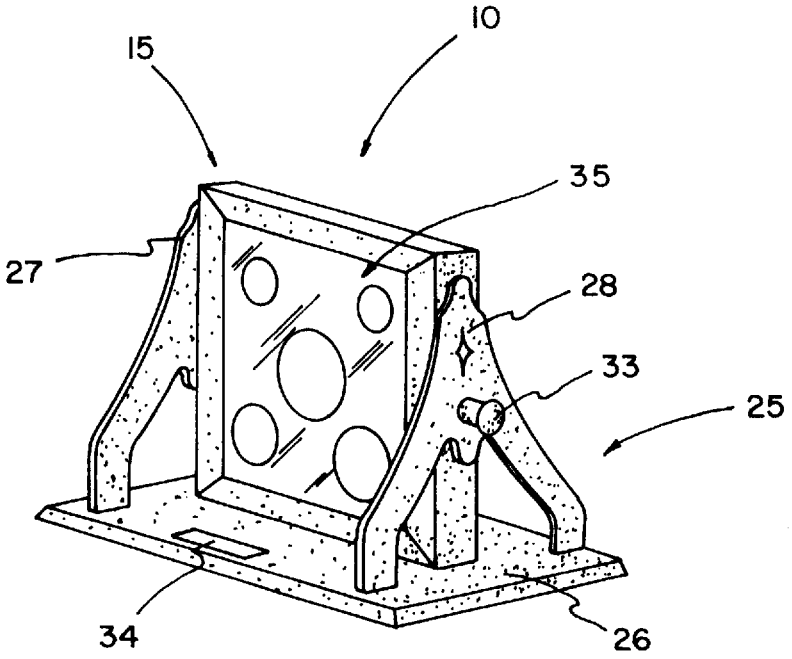
FIG. 1 is a perspective view of the revolving coin display stand of the present invention.

With further reference to the drawings there is shown therein a revolving coin display stand in accordance with the present invention, illustrated in FIG. 1 and indicated generally at 10.

In the embodiment shown in FIG. 1, the display stand 10 includes a United States Mint proof coin set, indicated generally at 35, installed therein.

Prior to discussing the details of the construction and function of the display stand 10, it may be beneficial to review the construction of the proof coin set 35 intended for use with the present invention.

Since 1968 the United States Mint has offered the proof coin set 35 in a rigid plastic display cartridge or lens 36. This plastic display cartridge or lens 36 is hermetically sealed and encapsulates the proof coins 37 therein. Thus, the coins 37 are protected from dust, dirt and any other contaminants which may be present while handling and viewing the proof coin set 35.

In a preferred embodiment, the coins 37 are arranged within a backing material 38 having a plurality of circular cutouts wherein the coins 37 are disposed so as to be viewed both from the obverse and reverse sides of the proof coin set 35.

Figure 2:
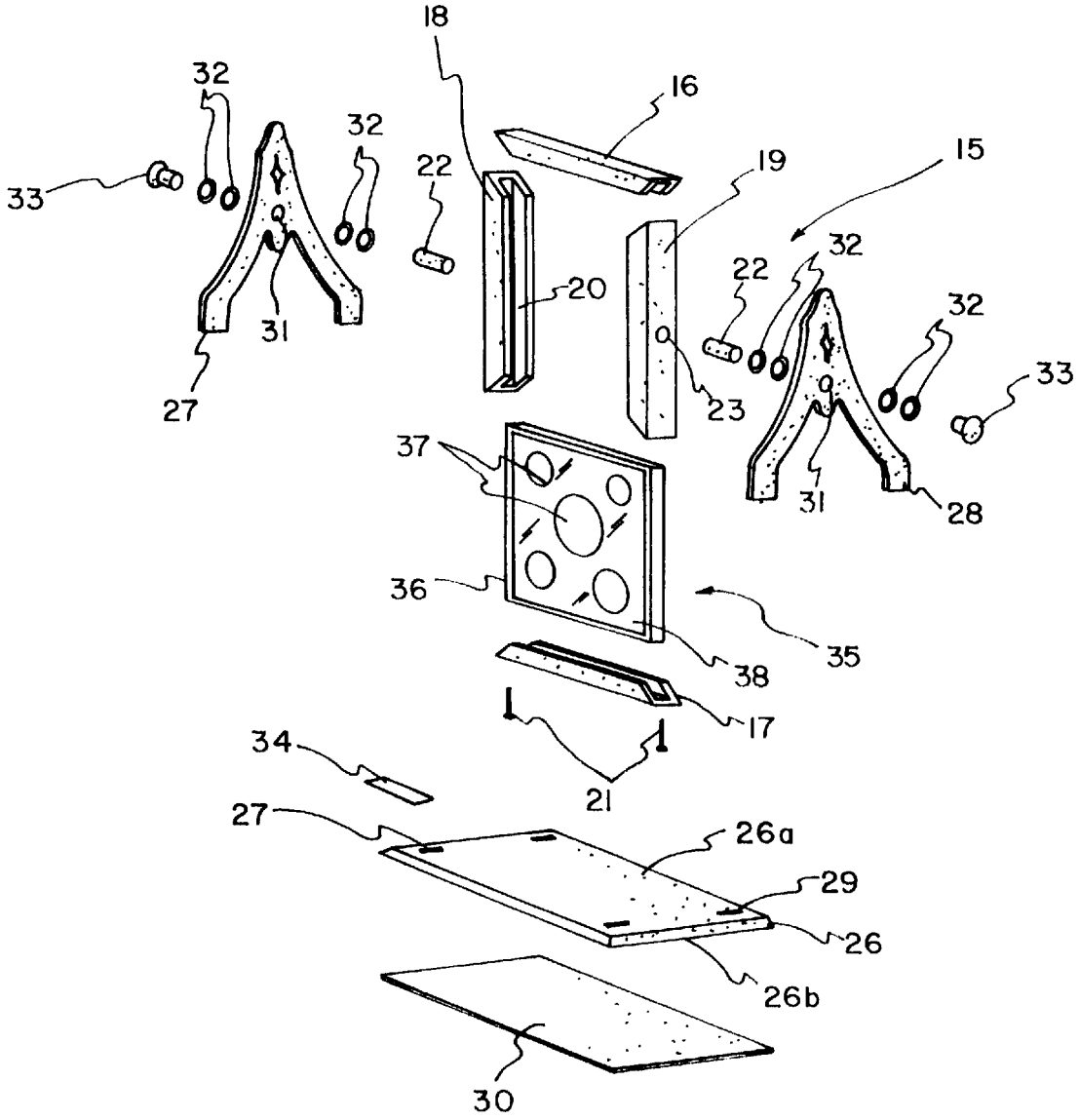
FIG. 2 is an exploded perspective view of the revolving coin display stand showing the details of the construction thereof.

Since 1968 and continuing to the present, the plastic lens 36 has been provided in a rectangular configuration as shown in FIG. 2 and measures approximately 5⅜" long ×3⅜" wide ×⅜" thick.

Since such proof coin sets are well known to those skilled in the art, further detailed discussion of the same is not deemed necessary.

Turning now to FIG. 2, the details of the construction and function of the revolving coin display stand 10 will now be described. The display stand 10 includes a frame assembly, indicated generally at 15 and a base support, indicated generally at 25.

Frame assembly 15 is generally rectangular in configuration and includes a pair of horizontally opposed frame members 16 and 17 and a pair of vertically opposed frame members 18 and 19 being mitered at their corner junctures so as to form the frame assembly 15.

In the preferred embodiment the individual frame members 16, 17, 18, and 19, are fabricated from a generally U-shaped material in cross-section defining a channel 20 therein.

The frame assembly 15 including the channel 20 is configured and dimensioned to conform to the outer peripheral edge of the proof coin set 35.

So assembled, the individual frame members 16, 17, 18, and 19, are secured at their corner junctures by screws 21 or other suitable fastening means. Thus, the proof coin set 35 is permanently captured within the frame assembly 15 as shown in FIG. 1.

The frame assembly 15 is provided with a pair of horizontally projecting pivot pins 22 which are installed in a pair of mating holes 23 having a common axis of symmetry and being formed at the midpoint of each of the vertical frame members 18 and 19 as shown in FIG. 2.

Pivot pins 22 are fixedly attached to vertical frame members 18 and 19 within holes 23 by suitable fastening means or adhesive.

Pivot pins 22 serve to impart 360° rotation of the frame assembly 15 within base support 25 as described hereinafter in further detail.

The frame assembly 15 including the proof coin set 35 is pivotally mounted within the base support 25. The base support 25 includes a generally rectangular base plate 26 being fixedly attached to a pair of upwardly projecting side braces 27 and 28.

In the preferred embodiment, side braces 27 and 28 are generally A-shaped in configuration including a pair of upwardly converging leg members being adapted for attachment to an upper surface 26*a* of base plate 26. Braces 27 and 28 are fabricated from any material having sufficient strength and rigidity to support frame assembly 15.

In this embodiment, base plate 26 is provided with a plurality of side brace mounting slots 29 which are formed at predetermined locations therein and adapted to receive the downwardly projecting leg members of side braces 27 and 28. So installed, the side braces 27 and 28 are secured in generally perpendicular relation to base plate 26 by suitable fastening means.

Base plate 26 is fabricated from any suitable material such as hardwood having sufficient weight to stabilize the display stand 10 in any position within its range of movement.

A bottom surface 26*b* of base plate 26 is provided with a pad 30 of a self-adhesive protective material such as felt to prevent scratching of the underlying furniture.

In order to install the frame assembly 15 including the proof coin set 35 within the base support 25, pivot pins 22 are inserted through a pair of pivot holes 31 having a common axis of symmetry and being formed in each respective side brace 27 and 28 as shown in FIG. 2.

It will be appreciated by those skilled in the art that pivot holes 31 have an inside diameter that is slightly larger than the outside diameter of pivot pins 22 such that pins 22 loosely penetrate pivot holes 31 imparting rotational movement to frame assembly 15.

Flat washers 32 are radially disposed about pivot pins 22 on both sides of each respective side brace 27 and 28 to prevent binding of the same against the vertical frame members 18 and 19.

Once assembled in the arrangement described above, a pair of end caps 33 are fixedly attached to the terminal ends of pivot pins 22 by a suitable fastening means.

Figure 3:
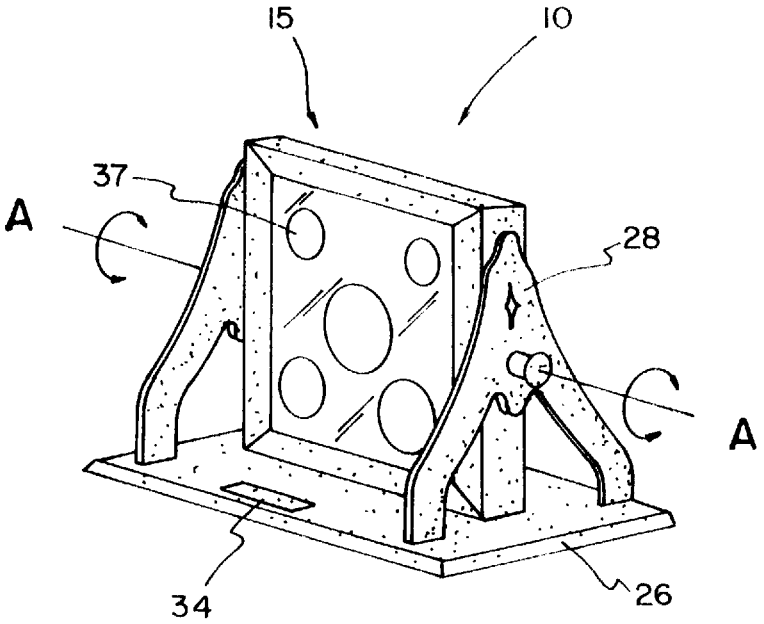
FIG. 3 is a perspective view of the revolving coin display stand illustrating the rotational movement of the frame assembly about longitudinal axis A.
Figure 4:
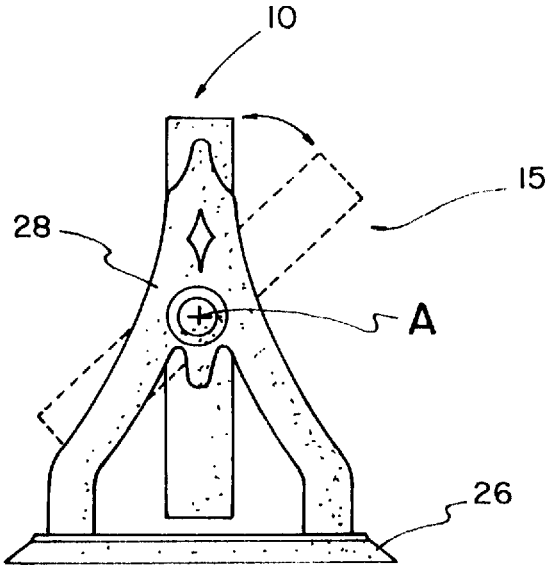

When assembled as described hereinabove, the frame assembly 15 is imparted with 360° of rotation about a longitudinal axis A extending through pivot pins 22 as shown in FIGS. 3 and 4.

In this arrangement, the user may view both the obverse and reverse sides of the proof coin set 35 by manually grasping either end cap 33 and rotating the same with fingers. Since the image on the reverse side of the proof coin set 35 is upside down or inverted with respect to the obverse image, the revolving frame feature allows the reverse side of the proof coin set 35 to be turned right-side up for proper viewing. This revolving feature also reduces the need of handling the proof coin set 35 in order to view the reverse side thereof. This in turn, will reduce the chance of damaging the proof coin set 35 due to mishandling.

In the preferred embodiment, the coin display stand 10 including the frame assembly 15 and the base support 25 are manufactured from natural hardwoods or other suitable materials being milled about the peripheral edges thereof to provide a distinctive, finished appearance. A brass tag or name plate 34 engraved to commemorate a special event or to add a personal touch may be installed on the base plate 26 by known fastening means.

Figure 5:
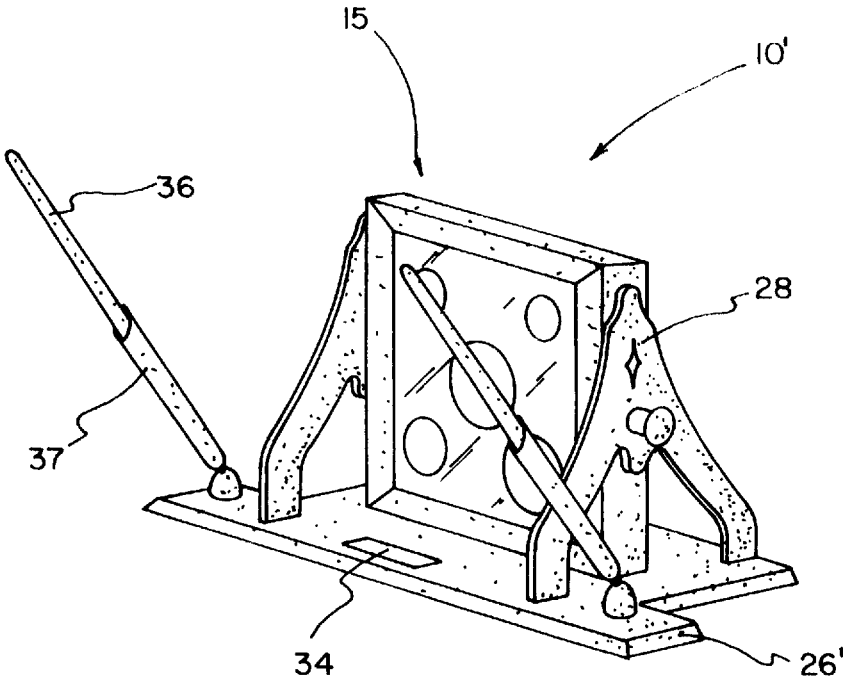
FIG. 5 is a perspective view of an alternative embodiment of the revolving coin display stand.

In an alternative embodiment, the coin display stand 10' can be modified to include a plurality of writing implements 36 such as a pen and/or pencil 36 together with their respective holders 37 being fixedly attached to a modified base plate 26' in a known manner as shown in FIG. 5.

From the above it can be seen that the revolving coin display stand of the present invention provides a practical and attractive means of displaying proof coin sets and related collectible items which allows the user to view both the obverse and reverse sides of the coins or other items without risk of damage to the same due to mishandling.

Since the image on the reverse side of the proof coin set is upside-down or inverted with respect to the obverse image, the revolving frame feature allows the reverse side of the coin set to be turned right-side up for proper viewing. In the preferred embodiment the revolving coin display is configured and dimensioned for use with proof coin sets issued by the United States Mint from 1968 to the present date.

In a modified version, the revolving proof coin display may be combined with a plurality of writing implements mounted thereon in the manner of a traditional desk set.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A revolving coin display stand in combination with a proof coin set, said coin display stand comprising:

a generally rectangular frame means configured and dimensioned to receive a standard proof coin set, said frame means being fabricated from a plurality of frame members generally U-shaped in cross-section and defining a channel extending the entire inner peripheering a said frame means, said frame members being installed about a peripheral edge of said proof coin set to permanently retain said proof coin set therein for mounting purposes, said frame means including pivoting means being fixably attached thereto and projecting outwardly therefrom, said pivoting means defining an axis of symmetry of said frame means; and base support means disposed in operative relation to said frame means, said base support means engaging said pivoting means so as to impart 360° rotational movement to said frame means about said axis relative to said support means enabling a user to alternatively view an obverse and a reverse side of said proof coin set and manually rotating said frame means about said axis.

2. The coin display stand of claim 1 wherein said frame members are mitered at the comer junctures thereof and joined by suitable fastening means.

3. The coin display stand of claim 1 wherein said base support means includes a generally rectangular base plate having a pair of upwardly extending brace members being fixedly attached thereto, said base members being adapted to receive said pivoting means therein to impart said rotational movement to said frame means.

4. The coin display stand of claim 3 wherein said pivoting means includes a pair of pivot pins being disposed in coaxial relation to said axis and projecting outwardly from said frame means for pivoting engagement with said brace members.

5. The coin display stand of claim 1 wherein said frame means is fabricated from hard wood material.

6. The coin display stand of claim 1 wherein said base support means is of sufficient weight to counterbalance said frame means together with a proof coin set to prevent said coin display stand from being toppled over during said rotational movement thereof.

7. The coin display stand of claim 1 wherein said base support means is provided with a plurality of writing implement holders mounted thereon to receive writing implements.

* * * * *